US008860616B2

(12) United States Patent
Lankes et al.

(10) Patent No.: US 8,860,616 B2
(45) Date of Patent: Oct. 14, 2014

(54) RFID-ANTENNA SYSTEM

(75) Inventors: Thomas Lankes, Rosenheim (DE); Frank Mierke, München (DE); Gerald Schillmeier, München (DE)

(73) Assignee: Kathrein-Werke KG, Rosenheim (DE)

( * ) Notice: Subject to any disclaimer, the term of this patent is extended or adjusted under 35 U.S.C. 154(b) by 785 days.

(21) Appl. No.: 13/128,839

(22) PCT Filed: Nov. 10, 2009

(86) PCT No.: PCT/EP2009/008020
§ 371 (c)(1),
(2), (4) Date: Jun. 7, 2011

(87) PCT Pub. No.: WO2010/054796
PCT Pub. Date: May 20, 2010

(65) Prior Publication Data

US 2011/0234463 A1 Sep. 29, 2011

(30) Foreign Application Priority Data

Nov. 11, 2008 (DE) ..... 10 2008 056 729

(51) Int. Cl.

| | |
|---|---|
| ***H01Q 21/00*** | (2006.01) |
| ***H01Q 1/22*** | (2006.01) |
| ***H01Q 7/00*** | (2006.01) |
| ***H01Q 1/52*** | (2006.01) |
| ***H01Q 9/04*** | (2006.01) |
| ***H01Q 3/26*** | (2006.01) |
| ***H01Q 21/06*** | (2006.01) |

(52) U.S. Cl.

CPC ..... *H01Q 1/2216* (2013.01); *H01Q 7/00* (2013.01); *H01Q 1/523* (2013.01); *H01Q 9/0407* (2013.01); *H01Q 3/26* (2013.01); *H01Q 21/065* (2013.01)

USPC ..... 343/728; 343/725

(58) Field of Classification Search

USPC ..... 343/725–728, 787–788; 235/487, 493

See application file for complete search history.

(56) References Cited

U.S. PATENT DOCUMENTS

| | | | | |
|---|---|---|---|---|
| 2003/0193437 | A1 | 10/2003 | Kangasvieri et al. | |
| 2004/0090368 | A1 | 5/2004 | Channabasappa et al. | |
| 2005/0104789 | A1 * | 5/2005 | Hashidate et al. | 343/725 |
| 2008/0048867 | A1 * | 2/2008 | Oliver et al. | 340/572.7 |
| 2008/0094302 | A1 | 4/2008 | Murch et al. | |

FOREIGN PATENT DOCUMENTS

| | | |
|---|---|---|
| DE | 10 2004 013 643 | 10/2005 |
| DE | 10 2007 018 059 | 10/2008 |

(Continued)

OTHER PUBLICATIONS

International Search Report for PCT/EP2009/008020, mailed Jan. 19, 2010.

*Primary Examiner* — Matthew Mikels
(74) *Attorney, Agent, or Firm* — Nixon & Vanderhye P.C.

(57) ABSTRACT

An improved RFID antenna system using a first RFID antenna device (in the form of a magnetic antenna (15)) and using a second RFID antenna device (21, 21') using a flat antenna is distinguished by the following features: the second RFID antenna device comprises one flat antenna (21, 21') or a group antenna with at least two flat antennas (21, 21'), and the metal plane of the flat antenna (21, 21') and/or the earth or reflector plane (31; 31.1; 31.2) is divided into metal, earth or reflector plane sections (31.1; 31.2) by slots, interruptions and or recesses (133), wherein the metal, earth or reflector sections (31.1; 31.2) are electrically conductively separated from one another or are electrically conductively connected to one another.

20 Claims, 8 Drawing Sheets

(56) References Cited

FOREIGN PATENT DOCUMENTS

| | | |
|---|---|---|
| EP | 1 418 643 | 5/2004 |
| WO | WO 2008/049354 | 5/2008 |
| WO | WO 2008/125345 | 10/2008 |
| WO | WO 2008/125346 | 10/2008 |

* cited by examiner

RFID-ANTENNA SYSTEM

This application is the U.S. national phase of International Application No. PCT/EP2009/008020 filed 10 Nov. 2009, which designated the U.S. and claims priority to German Application No. 10 2008 056 729.9 filed 11 Nov. 2008, the entire contents of each of which are hereby incorporated by reference.

The present invention relates to an RFID antenna system according to the preamble of claim 1.

A category-defining RFID antenna system is known for example from DE 10 2007 018 059 A1. This prior publication relates to the object of providing an improved RFID antenna system based on two RFID systems which operate at different frequencies. An RFID antenna system of this type may for example comprise an antenna device for an electronic article surveillance system (EAS), on the one hand, and an antenna device for a product identification system (PIS) for reading from tags provided with a microchip, on the other hand. Alternatively, the antenna system may also contain or comprise two independent product identification systems which operate in separate frequency bands. This is intended to be a system of fundamentally simple construction, in which it should be possible for the different antenna systems, for example for the EAS system on the one hand and for the PIS system on the other hand, not to have an adverse effect on one another. In other words, optimum integration of the two systems should be made possible.

The category-defining RFID antenna system thus comprises at least one first RFID antenna device, for example for an electronic article surveillance system (EAS), and at least one second RFID antenna device, for example for a product identification system (PIS). In this context, the described conventional EAS monitoring system is constructed in such a way that the antenna device comprises for example one or preferably two approximately rectangular frame antennae in one lateral boundary. In addition to this antenna system for the electronic article surveillance system (EAS), a UHF RFID system is provided and uses patch antennae, which are preferably arranged inside the frame antennae, for product identification (PIS).

One of the systems present in the antenna system is thus generally based on the use of magnetic antennae, i.e. antennae which are often constructed in the form of frame or loop antennae. Antennae of this type are characterised in that on the one hand, the magnetic components dominate over the electric components in the field distribution; and the smaller the perimeter of the antenna relative to the wavelength ($\lambda$), the more strongly this holds. On the other hand, magnetic antennae of this type are characterised in that the power emission of antennae of this type is comparatively low despite the high magnetic field strengths. Magnetic antennae of this type generally operate in the frequency range below 30 MHz. For example, the range around 8.2 MHz can be used in the relevant electronic article surveillance system and the range around 13.56 MHz can be used in the PIS system (HF RFID system).

The other, second RFID system (which is for example provided for a product identification system PIS) operates with antenna types in which the electromagnetic radiation is in the foreground. In this context, slot, patch or dipole antennae or array antennae consisting of these members or radiators are possible forms of antenna. This may for example involve a UHF RFID system which transmits and receives in a range of 800 MHz to 1 GHz, preferably for example in a range of 865 to 868 MHz or for example from 900 MHz to 930 MHz. The relevant antennae require an electrically conductive planar extension (referred to as a "plane radiator" hereinafter). The electrically conductive plane, for example in the form of a metal plane, may in this case act as the antenna itself (i.e. as a slot radiator), as a balancing antenna for the excitation (for example in the form of a patch antenna) or as a reflector (for example in the case of a dipole or cross-dipole in front of a reflector).

If an antenna system of this type is to be used with two individual RFID systems which operate in different frequency ranges (in such a way that one can be referred to as a relatively "high-frequency" system and the other as a relatively "low-frequency" system), it is possible to arrange the plane antenna which operates based on the electromagnetic radiation inside the magnetic antenna (in particular in the form of a frame or loop antenna) which operates based on the predominantly magnetic coupling.

However, the large metal surfaces desired for the plane antennae cause field alterations and screenings, which weaken the frame-shaped or loop-shaped magnetic antenna (for example for the aforementioned EAS system or the HF RFID system). These effects are particularly disadvantageous if the plane antenna is positioned for example parallel to the loop antenna or in the plane of the frame or loop antenna, i.e. in other words if the loop antenna encompasses the metal surface or at least parts of the plane antenna.

The object of the present invention is therefore to provide an improved RFID antenna system using a magnetic antenna and a plane antenna which operate in different frequency ranges.

The object is achieved according to the invention in accordance with the features given in claim 1.

Advantageous developments are given in the dependent claims.

In the context of the present invention, an improved RFID antenna system is provided by simple means and is in particular adapted for use as a product identification system (PIS) alongside further, low-frequency RFID systems (for example an article surveillance system EAS or a low-frequency PIS system).

In other words, the antenna system according to the invention may be one in which a surveillance portal, for example for an EAS system, is expanded with a product identification system (UHF RFID system), or in which for example two PIS systems (an HF RFID and an HF RFID system) are used for example for automation technology (in particular intended for use in connection with a conveyor belt).

The plane antennae used according to the invention (for example patch antennae, slot antennae or even dipole radiators, for example using a reflector etc.) are distinguished in that the metal or reflector plane used in connection with a corresponding radiator device (for example a dipole radiator or patch radiator) is altered in the constructional configuration thereof. The term "plane antenna" is understood to refer to types of antenna which comprise for example a metal plane forming the antenna (for example in the form of a slot or patch antenna) and/or comprise an earth or reflector plane which is provided in addition to the radiator, for example an earth or reflector plane in front of which a dipole radiator, a dipole square etc. or even a patch antenna is positioned which also comprises a further earth or reflector surface in addition to the metal plane forming the antenna. Specifically, according to the invention, the metal, earth or reflector plane comprises interruptions, indentations etc., increasing the overall length of the earth and/or reflector plane. Galvanic isolation of the earth and/or reflector plane into a plurality of earth and/or reflector portions is also possible. Further, it is also possible, in particular if an array antenna is used (which for example comprises two mutually laterally offset patch radiators or dipole radiators), for the intrinsically common earth and/or reflector plane to be divided into a plurality of earth and/or reflector plane portions for the for example two radiators or radiator devices. In this case, this metal, earth and/or reflector plane which is divided into a plurality of earth or reflector plane portions can also be connected via conductive material portions or via residual material bridges to an earth and/or reflector plane, which is common in the electrical meaning and is at a common potential. When notches are made in the common earth and/or reflector surface, it is even possible to provide connecting webs, which bridge the edges of the earth and/or reflector surface (and are equipped inter alia with concentrated components), between individual earth and/or reflector plane portions.

An antenna arrangement comprising at least two patch antennae, which are arranged in front of an earth and/or reflector plane, is in principle known from DE 10 2004 013 643 A1. The two patch antennae known therefrom are each positioned in front of an associated earth plane, which is galvanically isolated from the earth plane of the adjacent patch antenna. The reason for this galvanic isolation is to achieve improved decoupling, specifically when one antenna is used as a transmitting antenna and the other is used as a receiving antenna. In other words, the aforementioned prior publication discloses the use of two separate and independent antennae which are positioned at a small distance from one another. Galvanic isolation is therefore proposed for preventing coupling of these two independent antennae. However, the present invention relates by contrast to the problem of improving the antenna arrangement with two RFID antenna systems in which feedback from the higher-frequency antenna system to the lower-frequency antenna system is to be prevented irrespective of whether the higher-frequency antenna system comprises a single plane radiator or an array antenna comprising at least two plane radiators.

The antenna arrangement described above according to the invention is suitable above all if, in addition to the aforementioned plane antennae for an RFID antenna system (in particular for a product identification system—PIS), a further antenna device, for example in the form of a magnetic antenna (i.e. for example in the form of a frame or loop antenna) is to be used (for example for an electronic article surveillance system) and operates at a lower frequency (and thus a higher wavelength) than the plane antenna (which is for example in the form of the product identification system PIS). This is because the aforementioned division and/or partitioning of the earth and/or reflector plane into a plurality of earth and/or reflector plane portions, to increase the total perimeter of the earth and/or reflector plane, reduces the effect of the earth and/or reflector plane on the other antenna system having a wavelength $\lambda_2$ when $\lambda_2>\lambda_1$, $\lambda_1$ being for example the wavelength for the electromagnetically radiating plane antenna and $\lambda_2$ being for example the wavelength for the magnetically operating frame or loop antenna. In this case, the antennae for the relevant RFID antenna system are configured for an operating frequency or operating wavelength $\lambda_1$ provided for these plane antennae, it being possible for the earth and/or reflector plane to be of any desired size, although it should be greater than the size of the plane antenna or the associated earth and/or reflector plane (in a vertical plan view of the plane antennae and thus of the associated earth and/or reflector plane).

The invention is explained in the following by way of embodiments. In detail:

FIG. 1*a* is a schematic drawing of a monitoring region or monitoring opening according to the prior art, the antennae providing electronic article surveillance and the antennae provided for a product identification system (PIS) being depicted or shown in the left-hand antenna system;

FIG. 1*b* is a schematic view of the UHF antenna arrangement for an electronic article surveillance system (EAS) viewed in the direction of the opening, based on the drawing of FIG. 1*a* according to the prior art;

FIG. 2*a* is a schematic side view or cross-sectional view perpendicular to a reflector plane through two patch arrangements and the magnetic loop antenna surrounding them according to the prior art;

FIG. 2*b* is a plan view of the example known from the prior art according to FIG. 2*a;*

Figure 8A:
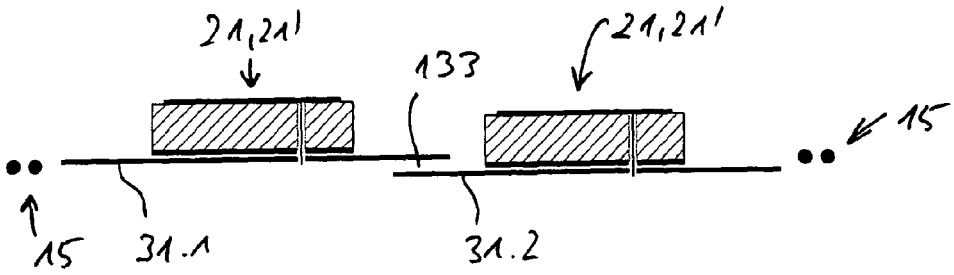
Figure 8B:
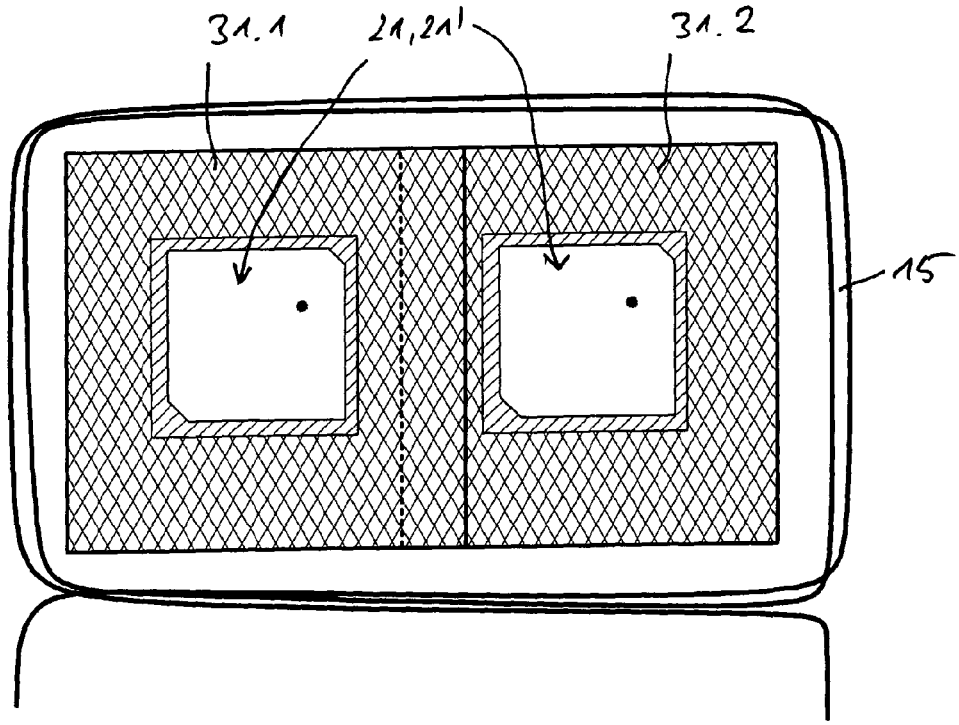

FIG. 8*a* is a side view or cross-sectional view of a modified antenna system in which the metal planes overlap at least in part at a distance from one another so as to provide a capacitive interaction;

FIG. 8*b* is a plan view of the embodiment of FIG. 8*a;*

Figure 3:
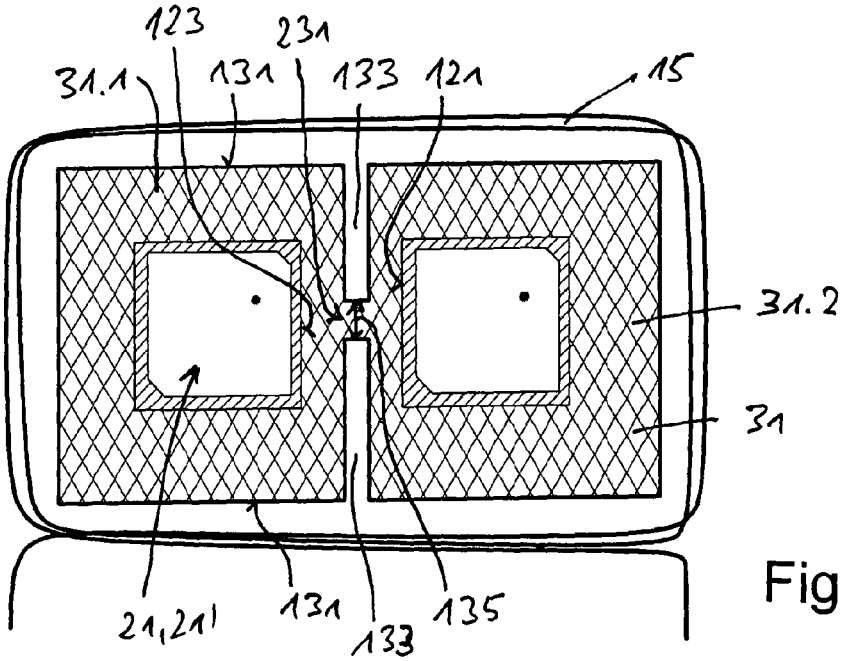
FIG. 3 is a plan view comparable to FIG. 2*b* of an RFID antenna system according to the invention.
Figure 9:
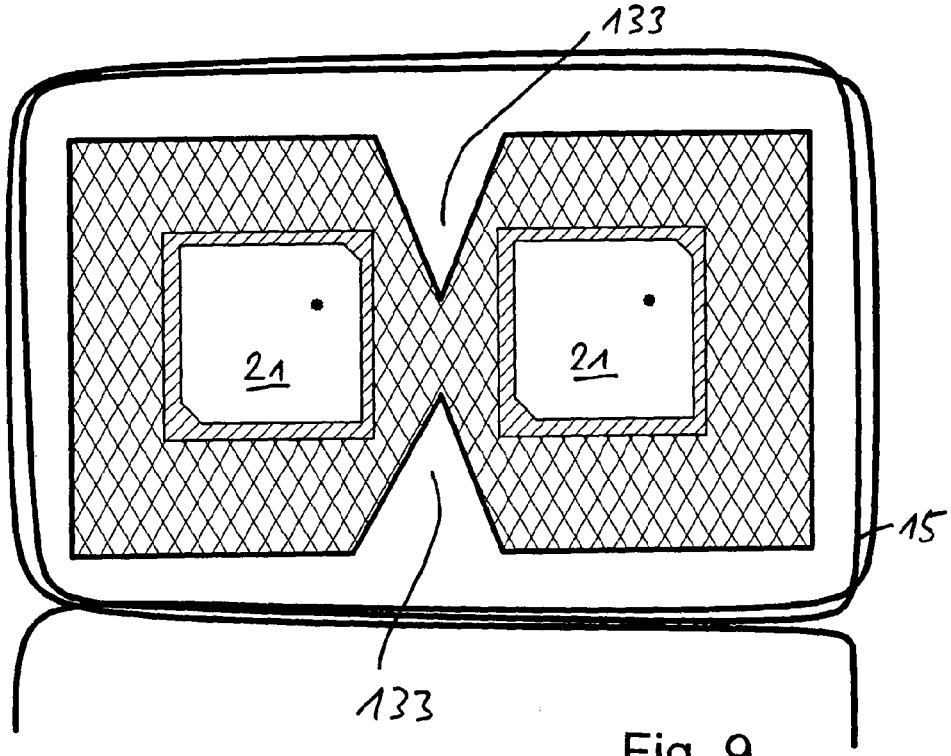
Figure 10:
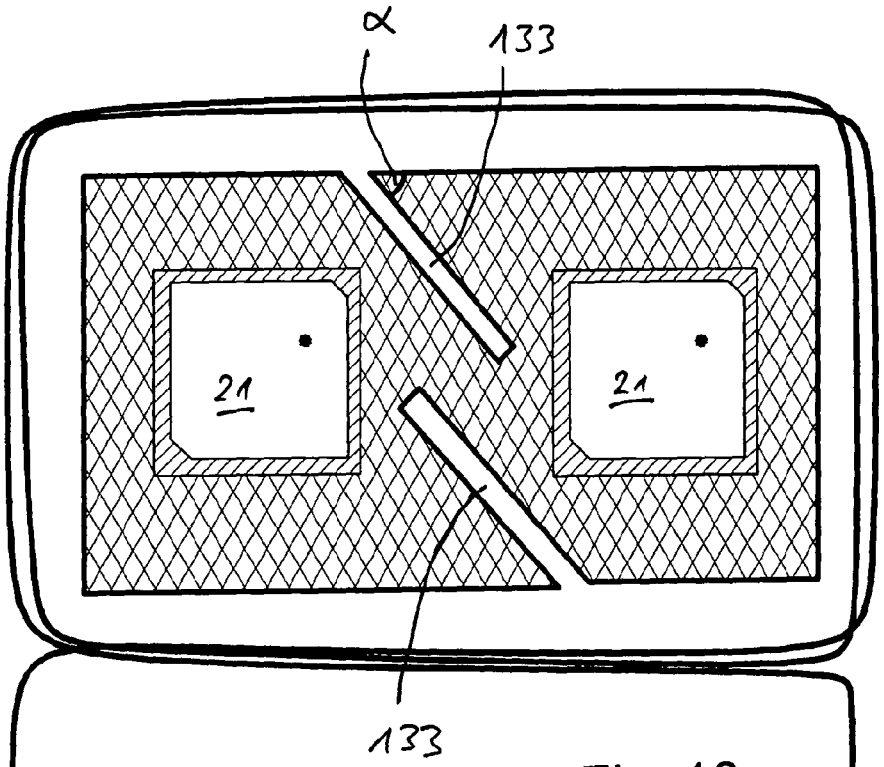
Figure 11A:
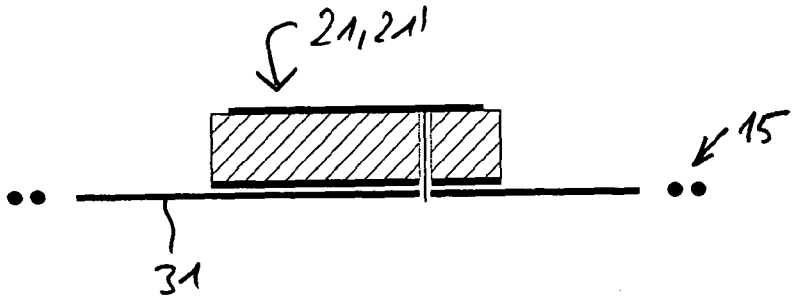
Figure 11B:
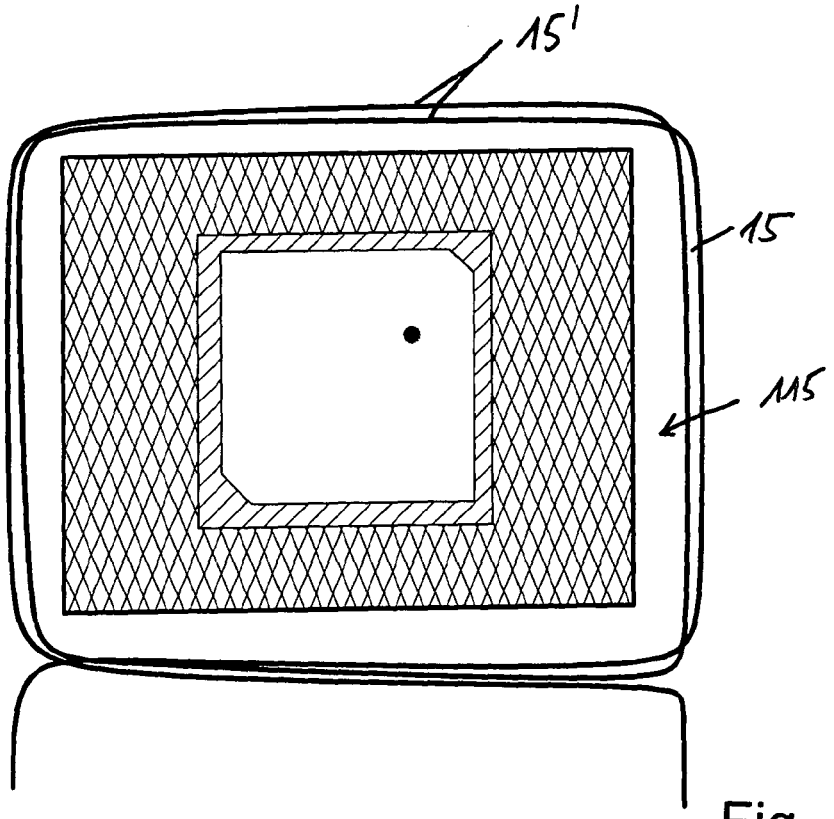

FIG. 9 is an embodiment modified from FIG. 3, comprising triangular recesses or slots;

FIG. 10 shows an embodiment modified from FIG. 3, in which the recesses or slots extend at an angle to a lateral boundary edge of the metal, earth and/or reflector plane;

FIG. 11*a* is a schematic side or cross-sectional view perpendicular to a reflector plane through a patch arrangement and the magnetic loop antenna surrounding it according to the prior art;

FIG. 11*b* is a plan view of an example known from the prior art according to FIG. 11*a;*

Figure 12A:
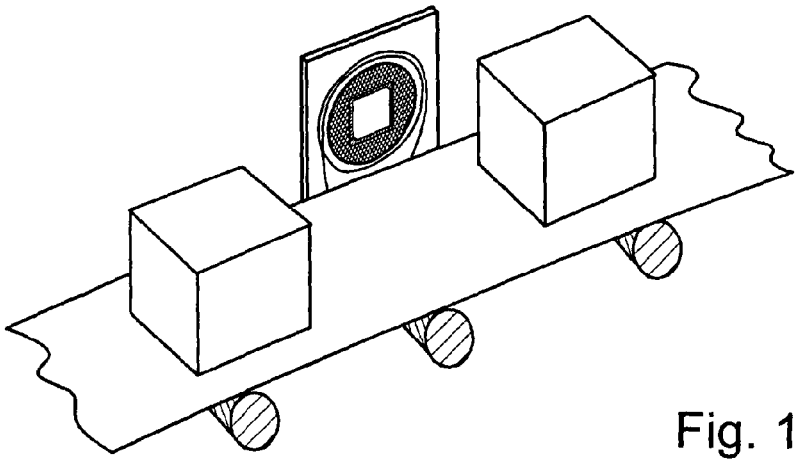
Figure 12B:
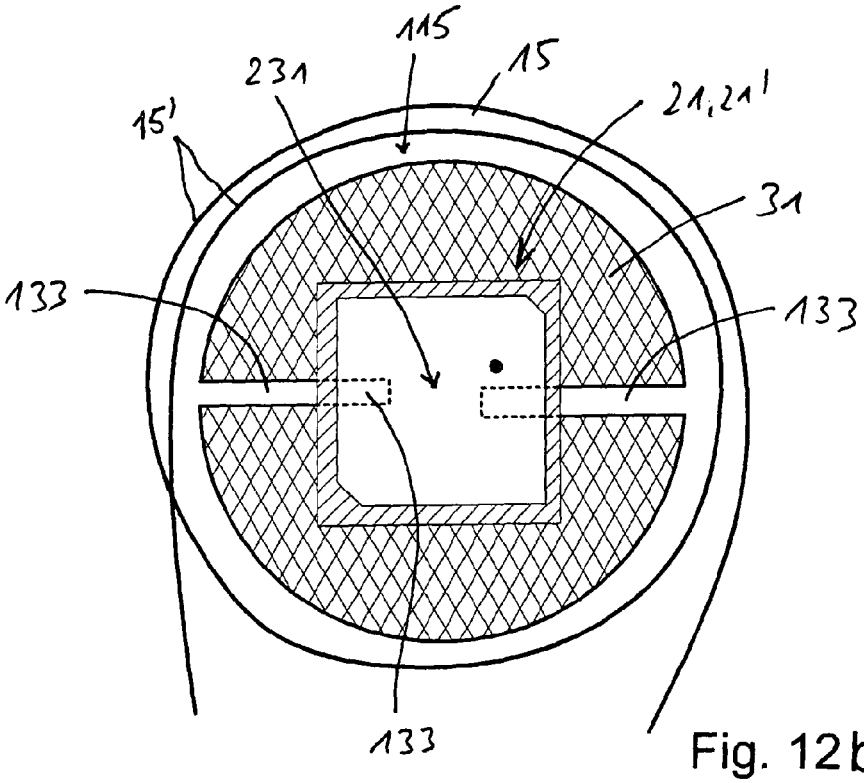

FIG. 12*a* is a schematic three-dimensional drawing illustrating an application of one of the antenna devices according to the invention, in which goods comprising a tag to be read out are moved past the antenna system on a conveyor belt; and FIG. 12*b* is a plan view comparable to FIG. 11*b* of an RFID antenna system according to the invention, in which the individual patch antenna is arranged on an approximately circular metal plane.

Figure 1A:
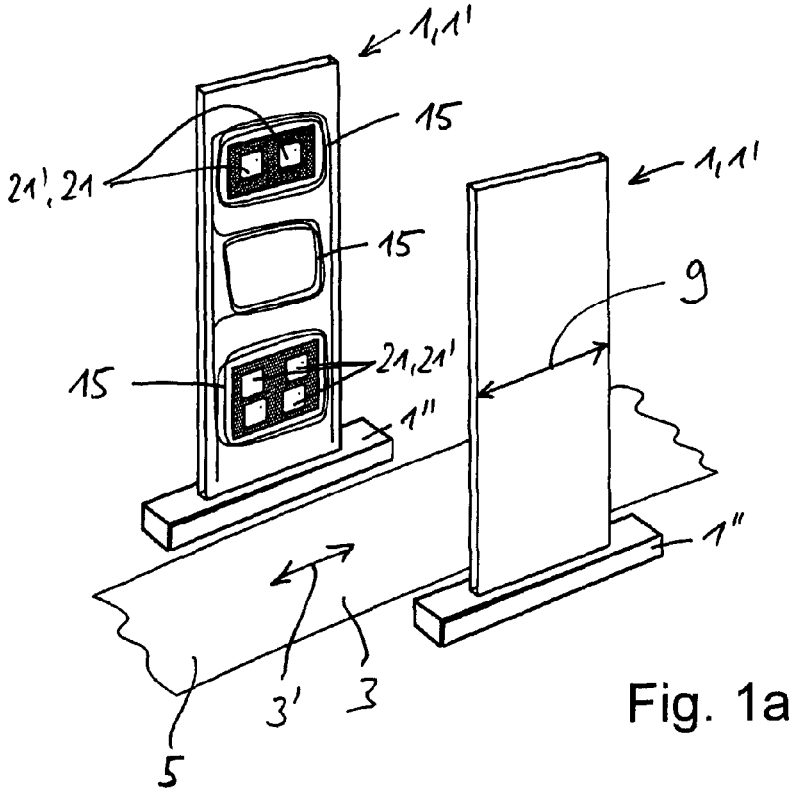
Figure 1B:
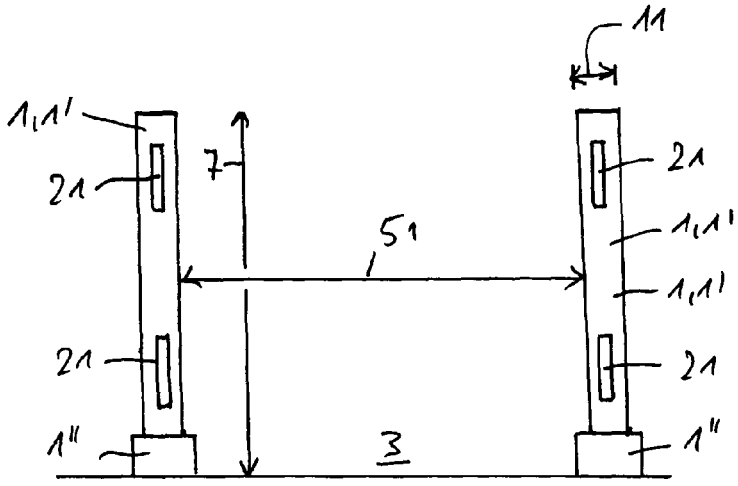

According to FIG. 1*a* and 1*b*, a product identification system (PIS) according to DE 10 2007 018 059 A1, for example in the form of a UHF RFID system, comprises two antenna devices 1, which are arranged offset at a distance 51 (FIG. 1*b*) from one another and between which an opening passage 3 extends along the opening direction 3' on a base surface 5.

The antenna devices 1 are formed in the manner of lateral boundaries 1', which basically have a height or vertical extent 7 extending transverse or in particular perpendicular to the base surface 5, a transverse or horizontal extent 9 extending parallel or substantially parallel or parallel with a component to the opening passage 3, and a comparatively small thickness 11 transverse or perpendicular to the opening direction 3 and thus in particular parallel to the base surface 5. Further, rectangular magnetic antennae 15 (magnetic frame antennae) are shown in dashed lines in FIG. 1 and are used for example for a conventional electronic article surveillance system (EAS).

The invention is described in the following using patch antennae, but these are merely mentioned as an example of plane antennae. It would also be possible to use slot radiators or for example dipole radiators (individual dipoles, cross-dipoles, dipole square etc.) in the form of or using a metal plane or in front of an earth and/or reflector plane. There are no restrictions in this respect.

Figure 2A:
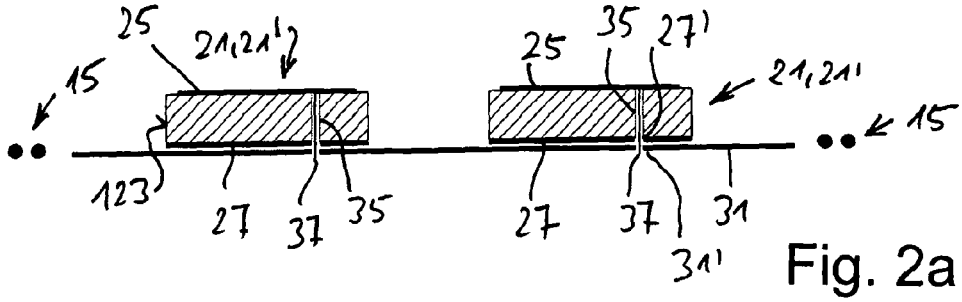
Figure 2B:
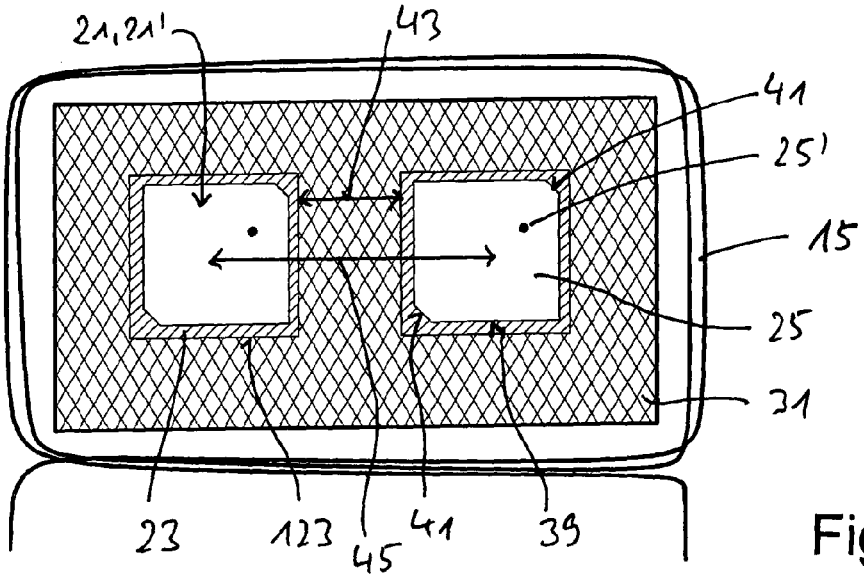

Reference is initially made to FIGS. 2*a* and 2*b*, which show an antenna arrangement according to the previously known DE 10 2007 018 059 A1 comprising two mutually laterally offset plane radiators 21 in the form of patch antennae 21', which are used for the higher-frequency product identification system (PIS) for example in the form of a UHF RFID system.

A pair of patch antennae 21' are shown by way of example and each comprise a substrate 23, a patch plane 25 and an earth and/or reflector plane 27 positioned underneath, the patch plane 25 and the earth and/or reflector plane 27 being arranged at a distance from one another corresponding to the thickness of the substrate 23.

As can also be seen from the schematic drawing in particular of FIG. 2*a*, the two patch antennae 21' are arranged parallel in front of an earth and/or reflector plane 31, specifically in such a way that the lower earth and/or reflector plane 27 of the respective patch antenna 21' becomes galvanically isolated from (i.e. comes into a capacitive arrangement with) the earth and/or reflector plane 31. The earth and/or reflector plane 31 thus protrudes past the patch antennae in a plan view and projects past the patch antenna laterally in all directions. The earth and/or reflector plane 31 may for example consist of metal or a metal sheet or alternatively for example of a copper-coated sheet metal blank.

Further, in the illustrated embodiment, a through-opening 31' is formed in the lower common earth and/or reflector plane 31, a through-opening 27' coincident therewith is formed in the respective earth and/or reflector plane 27 associated with the patch antenna 21', and an opening duct 35 is formed passing through the substrate 23, in such a way that a supply line 37, which is electrogaivanically connected to the upper patch plane 25 at a supply point 25', extends through this entire arrangement.

Alternatively, however, a capacitive coupling to the patch plane 25 in the region of the supply point 25' is also possible. Finally, it is possible to supply the patch plane 25 in such a way that for example the supply line 37 is connected to the patch plane, for example to the edge of the patch plane, in such a way as to be positioned and/or extend on the surface of the substrate 23 (i.e. parallel to the patch plane). However, the patch plane may also for example comprise a U-shaped recess or the like, in such a way that the supply line extending in the plane of the patch plane 25 is electrically connected to the patch plane by the end of the U-shaped recess (i.e. offset further inwards than the peripheral edge of the patch plane).

In the embodiment shown, the lower earth and/or reflector plane 27 extends as far as the peripheral side face 123 of the substrate 23, whilst the patch plane 25 visible in the plan view of FIG. 2*b* ends at a distance 39 from the lateral boundary or side face 123 of the substrate 23, i.e. is formed with a longer longitudinal and transverse extent, as seen in a plan view, than the lower earth and/or reflector plane 27 of the patch antenna 21'.

In the embodiment shown, the at least approximately square-shaped face of the patch antenna 21' is provided with a bevel 41, for tuning the antenna, on two diagonally opposite corners.

If air is used as the substrate 23, corresponding dielectric spacers have to be used, which merely provide mechanical mounting for the patch plane 25 and which hold and fix the patch plane 25 at a distance from the earth and/or reflector plane 31.

Two patch antennae formed in this manner according to the embodiment of FIGS. 2*a* and 2*b* are arranged at a lateral distance 43 (i.e. with a slight lateral distance 43 between two mutually facing lateral boundary faces 123 of the two adjacent patch antennae), specifically on a common earth and/or reflector plane 31, i.e. generally a conductive or metal plane 31.

In the embodiment shown, the distance between the two centre points of the patch antennae or the centres of gravity of the two patch antennae is denoted as 45.

This centre-to-centre distance 45 should be greater than or equal to 0.2 times λ (lambda) for the operating frequency used by the patch antennae, preferably the average wavelength of the frequency used, specifically for example equal to 0.2×34 cm=5 cm.

An optimum distance might be $$0.5\times\lambda(\approx 0.5\times 34\text{ cm}=17\text{ cm}),$$

in particular for example if the UHF RFID antenna system operates at a frequency of 868 MHz.

The edge lengths of a patch antenna or a patch pair, i.e. in particular the associated earth and/or reflector plane 31, may for example preferably be 5 cm to 50 cm.

The patch antennae 21' used to provide an electronic product identification system (PIS) preferably operate in the UHF frequency range, i.e. for example in a range of 800 MHz to 950 MHz or 1000 MHz (in particular in a range for example of 865 MHz to 868 MHz or in a range for example of 900 MHz to 930 MHz). If the aforementioned antenna system operating in a first frequency range f1 is used with a further antenna system using a magnetic antenna 15, i.e. in particular a frame or loop antenna 15, which for example operates in a lower frequency range f2 differing from the first frequency range f1 (for example in a range of 30 kHz to 30 MHz, in particular around 8.2 MHz, in particular if this is an EAS system), this disadvantageously weakens the frame or loop antenna. In this case, as stated, the plane antennae operate in a higher frequency range than the plane or loop antennae.

Next, FIG. 3 shows an improvement according to the invention on a variant shown in FIGS. 2*a* and 2*b*, specifically in a plan view comparable to the drawing of FIG. 2*b*. Unlike in FIG. 2*b*, however, in this case slot-shaped interruptions 133, which slope towards one another, are made in the earth and/or reflector plane 31 on the two longitudinal sides 131 of the earth and/or reflector plane 31 (i.e. in the direction in which the two patch antennae 21' are mutually offset) and end at a distance 135 from one another. In other words, the slot-shaped interruptions 133 are arranged extending in a region perpendicular to the installation direction or parallel to the two adjacent lateral boundaries 121 of the patch antennae 21'. The two mutually facing ends of the slot-shaped interruption form a connecting portion 231 between the two earth and/or reflector plane portions 31.1 and 31.2. In other words, the two slot-shaped interruptions 133 divide the intrinsically provided earth and/or reflector plane 31, which is characterised by the rectangular shape with a predetermined length and predetermined width, into two earth and/or reflector plane portions 31.1 and 31.2, which are conductively, i.e. galvanically, connected by the connecting portions or the connecting bridge 231.

The variant of FIG. 3 is thus an RFID antenna system comprising a first RFID antenna device 15 having a magnetic antenna 15 and a second RFID antenna device having at least two plane antennae 21, 21', the plane antennae 21, 21' generating radiation substantially or predominantly based on an electromagnetic coupling in a frequency range f1. The second RFID antenna device thus forms a group antenna having two plane antennae 21, 21'. By contrast, the magnetic antenna 15 generates radiation substantially or predominantly based on a magnetic coupling in a frequency range f2 lower than the first frequency range f1. In this embodiment too, the second RFID antenna in the form of an array antenna having at least two plane antennae 21, 21' is arranged substantially or at least approximately inside the frame-shaped or loop-shaped magnetic antenna 15, the arrangement being such that the plane antenna 21, 21' is positioned inside the frame-shaped or loop-shaped magnetic antenna 15 as viewed perpendicular to the metal, earth and/or reflector plane 31.

The second RFID antenna device comprising the two aforementioned plane antennae 21, 21' is an array antenna. In this context, an array antenna provides common transmission and/or reception of electromagnetic waves in a known manner. In other words, the two plane radiators 21, 21' simultaneously transmit at the same frequency or in the same frequency band or simultaneously receive the same frequency or the same frequency band.

The described configuration thus increases the total length of the outer perimeter of the metal, earth and/or reflector plane 31. This reduces the effect on and in particular the weakening of the second RFID antenna system (for example using a frame or loop antenna) operating in a low-frequency range, i.e. the effect exerted by the first RFID antenna system based on plane antennae in the higher-frequency frequency range.

Figure 4:
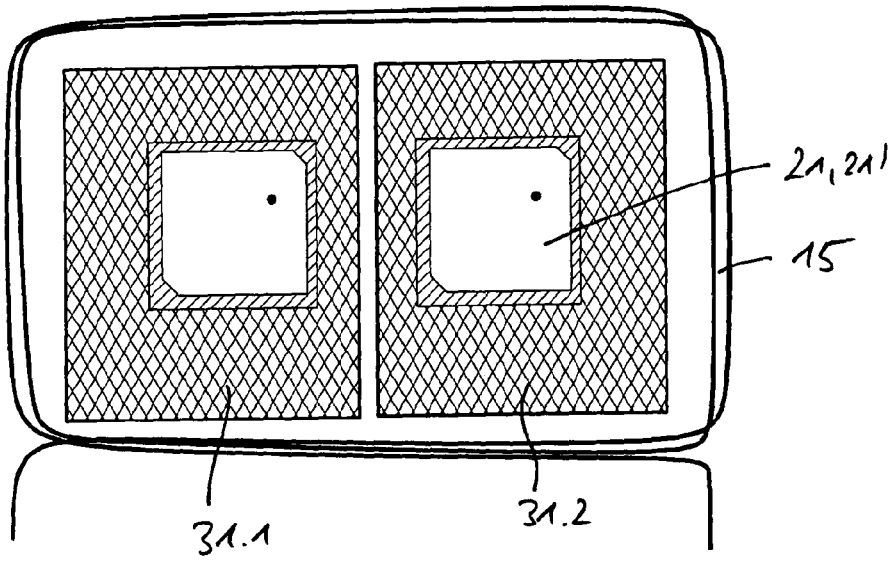
FIG. 4 shows an embodiment differing from FIG. 3, comprising two fully separated metal or earth planes.

FIG. 4 shows that the earth and/or reflector plane 31 is no longer divided into two galvanically connected earth and/or reflector plane portions 31.1 and 31.2, instead being divided into two separate earth and/or reflector plane portions 31.1 and 31.2.

Figure 5:
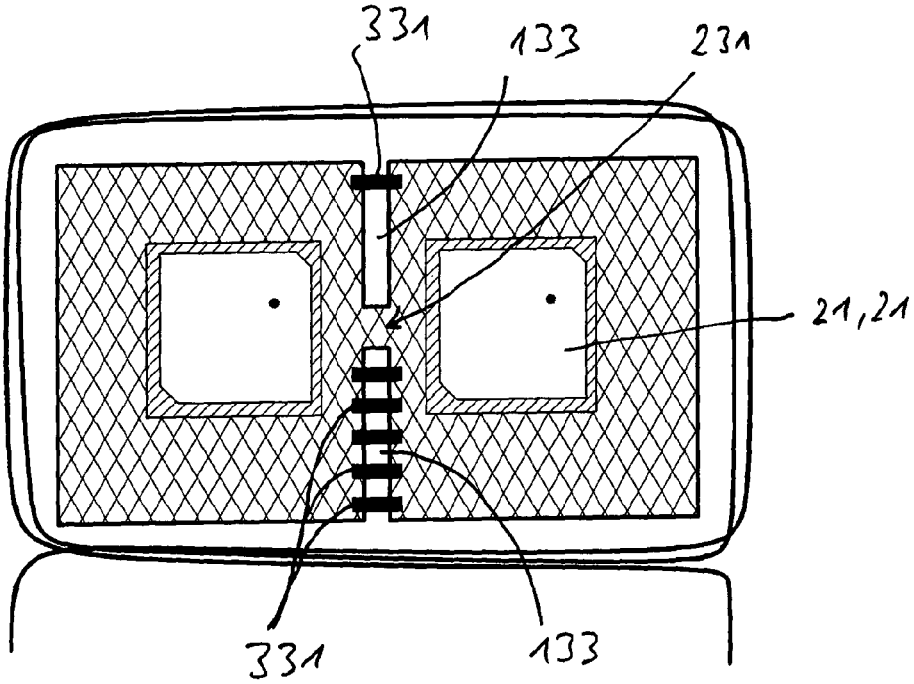
FIG. 5 shows an embodiment modified from FIG. 4, using additional connecting bridges which connect adjacent regions of two metal, earth and/or reflector planes via concentrated components.

The embodiment of FIG. 5 shows that additional connecting bridges 331 may be provided, which are arranged at suitable points, bridge the interruptions 133 (for example in the form of the aforementioned slots), and connect the adjacent conductive earth and/or reflector portions 31.1 on both sides of the slots 133, preferably capacitively (or via other components). This embodiment according to FIG. 5 is predominantly suitable when the aforementioned indentations 133 in the metal plane 31 have an excessively strong effect on the higher-frequency system, for example on the antenna pattern. By bridging the indentations 133 via individual or a plurality of discrete components (i.e. concentrated components) (via active components, passive components, preferably in the form of capacitors, condensers etc., in various embodiments for example as surface-mountable components in the form of SMD or wired components), if there is a sufficient difference in frequency between the two systems, it can be provided for the low-frequency (magnetic) system that these bridges become high-resistance, whilst they are low-resistance for the higher-frequency system (electromagnetic coupling), in other words, the additional component causes the slots for the higher-frequency system to become virtually ineffective.

Figure 6:
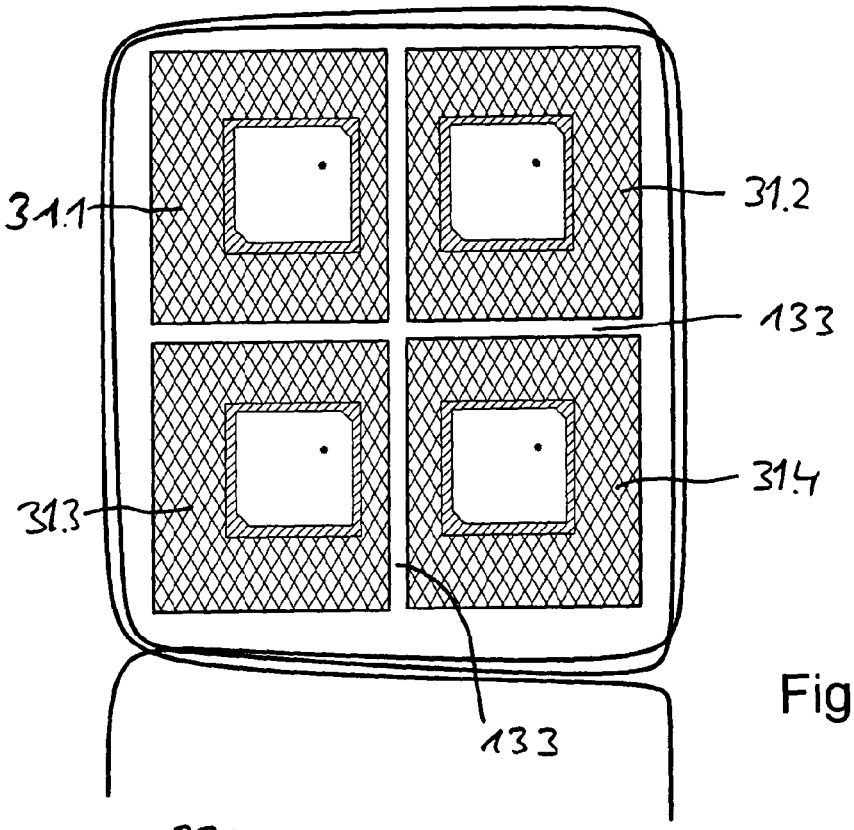
FIG. 6 shows a further modified embodiment using four separate metal planes.

The embodiment of FIG. 6 shows that for example when using more than two patch antennae, in this case using four patch antennae, they may for example be arranged on four separate earth and/or reflector plane portions 31.1, 31.2, 31.3 and 31.4. However, in this case too, additional connecting bridges 331, comparable with the example of FIG. 5, or residual connecting portions 231 could be provided, which connect at least two earth and/or reflector plane portions or each comprise one connection to a laterally adjacent earth and/or reflector plane portion, in such a way that in this embodiment, if appropriate, all four earth and/or reflector plane portions 31.1 to 31.4 may be connected electrogalvanically by four residual connecting portions 231.

Figure 7:
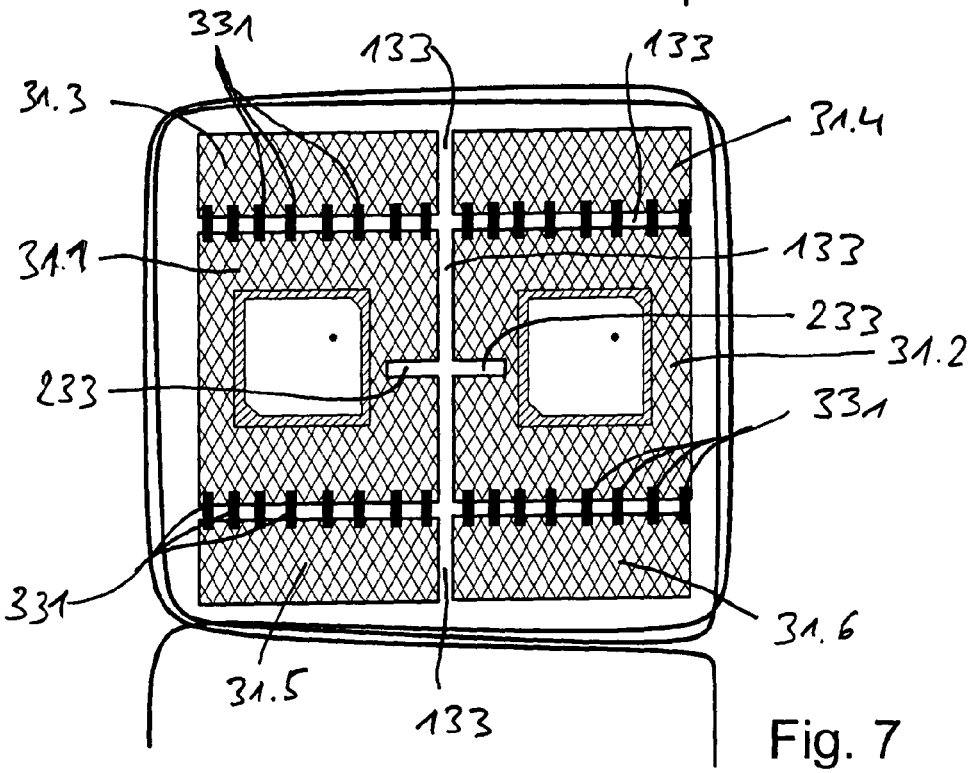
FIG. 7 shows an embodiment modified from FIG. 4, in which further parts of the earth/reflector plane have additionally been bridged via connecting webs comprising concentrated components.

FIG. 7 shows a further modification, in which in addition to the separated earth and/or reflector plane portions 31.11 and 31.2, in front of each of which a patch antenna 21' is arranged, four further earth and/or reflector plane portions 31.3, 31.4, 31.5 and 31.6 are also additionally provided, which in this embodiment are also connected by corresponding connecting bridges 331 to the earth and/or reflector planes 31.1 and/or 31.2 and/or to one another in different variations. In addition, an enlargement slot 233 is also provided, which further increases the total perimeter of the earth and/or reflector plane 31, ends in the respective earth and/or reflector plane, and in each case extends orientated transverse, i.e. perpendicular in the embodiment shown, to the adjacently positioned patch antenna 21' and ends shortly before the relevant patch antenna 21'.

The cross-sectional view of FIGS. 8*a* and 8*b* merely shows that the individual earth and/or reflector planes may also be in different planes, i.e. in particular in a parallel orientation in different planes. In this case, the earth planes 31.1 and 31.2 may also overlap (as can be seen in the plan-view drawing of FIG. 8*b* and the side-view drawing of FIG. 8*a*). In this case too, the earth and/or reflector planes 31 of the two patch antennae shown in cross-section may be interconnected by connecting bridges 331 in a manner similar to that shown in FIG. 5 or 7. Alternatively, material portions 231 left behind by edging or stamping may be provided, via which the two earth and/or reflector planes 31 which are mutually offset, i.e. orientated towards one another on two planes, are interconnected in a manner similar to that shown in FIG. 5. Partitioning the metal or earth planes 31 and arranging them in different planes with the resulting at least partial overlap makes capacitive coupling possible for the higher-frequency antenna system.

FIG. 9 merely shows that the recesses or slots 133 need not be formed by mutually parallelly extending boundary edges on the earth and/or reflector planes, i.e. the recesses need not have rectangular constructions, but may also be characterised by different shapes. In the variant of FIG. 9, the separation or dividing slots are for example of a converging or triangular form, other recess shapes and configurations also being possible.

FIG. 10 additionally shows that the division slots also need not extend parallel to a further boundary edge of the earth and/or reflector plane, but may also for example be orientated transverse thereto at an angle $\alpha$. In this context, a plurality of slots need not even be orientated mutually parallelly, and may also have a shape other than the rectangular shape.

Finally, FIG. 11*a* and 11*b* and FIGS. 12*a* and 12*b* show that the advantages according to the invention of a loop-shaped or frame-shaped magnetic antenna 15, on the one hand, and a plane radiator 21, on the other hand, for example in the form of a patch antenna 21, are still provided even if, for a frame or loop antenna 15, instead of an array antenna comprising at least two plane radiators an antenna arrangement merely comprising one plane radiator is used, which in a plan view is positioned transverse to the metal, earth and/or reflector plane inside the frame or loop antenna 15, substantially or at least approximately in such a way that at least the vertical projection of the metal, earth and/or reflector 31 of the plane antenna 21, 21' is positioned inside the frame-shaped or loop-shaped magnetic antenna 15.

In this context, FIG. 11*a* is a schematic cross-section and FIG. 11*b* is a plan view of a generally conventional prior art solution, whilst the plan view of FIGS. 12*a* and 12*b* illustrates the solution according to the invention. It is also shown that the frame or loop antenna need not necessarily have an approximately rectangular basic construction, but may also for example comprise blades laid in an oval or circular shape or individual blades 15' laid at least approximately in an oval or circular shape, in such a way that the plane radiator arranged inside the free space 115 formed in this manner comprises for example an earth and/or reflector plane 31 adapted in accordance with this shaping of the magnetic antenna 15 and having an approximately circular base face in the embodiment shown in FIG. 12.

In this case too, two slots 133 are provided, which for example are positioned diametrically opposite one another and extend from the outside into a central region of the earth and/or reflector plane 31 and subsequently end at a distance from one another. In the patch antenna used in FIG. 12, the embodiment also shows that these recesses 133 may also end underneath the corresponding plane radiator 21, where a connecting bridge 231 remains between the two halves or portions of the earth and/or reflector plane 31.

In this context, FIG. 12*a* shows a corresponding arrangement according to the invention, for example for the field of logistics, comprising a conveyor belt on which goods having a corresponding tag are moved past an antenna device, which may be constructed as shown in FIG. 12*b* and disclosed above.

The embodiments shown demonstrate inter alia that because of the aforementioned slots or the additionally provided earth and/or reflector plane portions (which may also be fully electrogalvanically isolated from other earth and/or reflector plane portions), the for example rectangular, square, round or curved configuration of the metal, earth and/or reflector plane 31 has an overall shape which deviates from a simple rectangular shape, square shape, circular shape etc. It is common to all embodiments that the earth and/or reflector plane achieves an increased perimeter by way of the specific configuration, preventing or reducing the adverse effect of these patch antennae on the other antenna system (for example the electronic article surveillance system EAS).

The aforementioned slots, interruptions and/or recesses between two adjacent earth planes and/or portions may be dimensioned differently in length and/or width. In the embodiment shown, these slots 133 are often configured in length in such a way as to correspond to between 10% and 90% of the length or width of the associated metal, earth or reflector plane 31, preferably between 20% and 80%, in particular between 30% and 70% of the length or width of the corresponding earth and/or reflector plane.

This width of the slot-shaped interruptions may also be defined using the wavelength of the operating frequency of the associated patch antennae. This distance or the width of the interruption should thus be less than 15%, in particular less than 3%, of the associated operating wavelength of the corresponding frequency range of the associated patch antennae.

The aforementioned distances may be larger when the corresponding adjacent earth and/or reflector plane portions are electrogalvanically interconnected by connecting points and/or connecting bridges and/or for example capacitively interconnected via discrete components.

This is preferably an antenna type which requires a metal and/or reflector plane at a small distance from the radiator device, in particular a metal plane as the antenna itself (for example in the form of a slot radiator), as a balancing antenna (for excitation in relation to the metal plane for example in patch antennae), or as a reflector for beam formation, for example including when dipoles, cross-dipoles, dipole squares etc. are arranged in front of the reflector.

As stated, an extremely wide range of plane radiators may be used for the higher-frequency antenna system which is based on electromagnetic radiation. As stated, this involves a type of antenna which comprises a metal plane, on the one hand, and/or an earth or reflector plane in addition to the radiator device, on the other hand. In other words, this is preferably a type of antenna comprising a metal plane as an antenna (for example in the form of a slot radiator) and/or an antenna type comprising an earth plane as a balancing antenna (for excitation towards the metal plane, for example in a patch antenna) and/or an antenna type comprising a reflector for beam formation, for example a radiator arrangement comprising the aforementioned dipoles, cross-dipoles, dipole squares etc. which are arranged in front of a reflector.

The aforementioned metal, earth and/or reflector planes may consist of metal conductive planes, for example of sheet metal constructions with or without surface treatment, for example including conductor plates or sheet metal blanks which are laminated with an electrically conductive surface, for example provided or covered with a copper surface. There are also no restrictions in this respect.

The invention claimed is:

1. RFID antenna system comprising:

at least a first RFID antenna device comprising a magnetic antenna and a second RFID antenna device comprising at least one plane antenna, the plane antenna generates radiation in a first frequency range (f1), the magnetic antenna generates radiation in a second frequency range (f2) lower than the first frequency range (f1), and the second RFID antenna device comprising the at least one plane antenna arranged inside or in front of the frame-shaped or loop-shaped magnetic antenna, in such a way that the vertical projection of the metal, earth and/or reflector plane of the at least one plane antenna is inside the frame-shaped or loop-shaped magnetic antenna, the second RFID antenna device comprises one of the plane antennae or an array antenna comprising at least two plane antennae, and the plane antennae comprises for this purpose either a) a metal plane as a radiator device, which is divided into metal plane portions by slots, interruptions and/or recesses, the metal plane portions being galvanically isolated from or connected to one another, or b) an earth or reflector plane which acts as a balancing antenna or reflector and is provided in addition to the radiator device, projects laterally past the radiator device, and is divided into earth or reflector plane portions by slots, interruptions and/or recesses, the earth or reflector plane portions being galvanically isolated from or galvanically connected to one another, further including at least one and preferably a plurality of connecting bridges interconnecting two adjacent metal, earth or reflector plane portions, via concentrated components, wherein the connecting bridge(s) consist of individual or a plurality of concentrated active and/or concentrated passive components.

2. RFID antenna system according to claim 1, comprising at least two metal, earth or reflector portions electrogalvanically interconnected via a residual connecting portion, the slots, interruptions and/or recesses ending adjacent to the connecting portion.

3. RFID antenna system according to claim 1, wherein the connecting bridges comprise an electrogalvanic connection.

4. RFID antenna system according to claim 1, wherein the concentrated active and/or concentrated passive components consist of or comprise capacitors or condensers.

5. RFID antenna system according to claim 1 wherein additional recesses, preferably additional slot-shaped recesses, are provided to increase the total perimeter of the metal, earth or reflector plane, and are provided additionally as separate recesses from the other slots, interruptions and/or recesses and/or branch off from the other slots, interruptions and/or recesses.

6. RFID antenna system comprising:

at least a first RFID antenna device comprising a magnetic antenna and a second RFID antenna device comprising at least one plane antenna, the plane antenna generates radiation in a first frequency range (f1), the magnetic antenna generates radiation in a second frequency range (f2) lower than the first frequency range (f1), and the second RFID antenna device comprising the at least one plane antenna arranged inside or in front of the frame-shaped or loop-shaped magnetic antenna, in such a way that the vertical projection of the metal, earth and/or reflector plane of the at least one plane antenna is inside the frame-shaped or loop-shaped magnetic antenna, the second RFID antenna device comprises one of the plane antennae or an array antenna comprising at least two plane antennae, and the plane antennae comprises for this purpose either a) a metal plane as a radiator device, which is divided into metal plane portions by slots, interruptions and/or recesses, the metal plane portions being galvanically isolated from or connected to one another, or b) an earth or reflector plane which acts as a balancing antenna or reflector and is provided in addition to the radiator device, projects laterally past the radiator device, and is divided into earth or reflector plane portions by slots, interruptions and/or recesses, the earth or reflector plane portions being galvanically isolated from or galvanically connected to one another, wherein the slot-shaped interruptions are of a length which is between 10% and 90% of the length of the relevant metal, earth or reflector planes, including between 20% and 80% and between 30% and 70%.

7. RFID antenna system comprising:

at least a first RFID antenna device comprising a magnetic antenna and a second RFID antenna device comprising at least one plane antenna, the plane antenna generates radiation in a first frequency range (f1), the magnetic antenna generates radiation in a second frequency range (f2) lower than the first frequency range (f1), and the second RFID antenna device comprising the at least one plane antenna arranged inside or in front of the frame-shaped or loop-shaped magnetic antenna, in such a way that the vertical projection of the metal, earth and/or reflector plane of the at least one plane antenna is inside the frame-shaped or loop-shaped magnetic antenna, the second RFID antenna device comprises one of the plane antennae or an array antenna comprising at least two plane antennae, and the plane antennae comprises for this purpose either a) a metal plane as a radiator device, which is divided into metal plane portions by slots, interruptions and/or recesses, the metal plane portions being galvanically isolated from or connected to one another, or b) an earth or reflector plane which acts as a balancing antenna or reflector and is provided in addition to the radiator device, projects laterally past the radiator device, and is divided into earth or reflector plane portions by slots, interruptions and/or recesses, the earth or reflector plane portions being galvanically isolated from or galvanically connected to one another, wherein the width of the interruptions or slots is less than 15% and including less than 3% of the wavelength of the higher-frequency antenna system, based on the average frequency and the associated average wavelength of the higher-frequency system.

8. RFID antenna system according to claim 1 wherein the metal, earth or reflector plane portions or at least a plurality of metal, earth or reflector plane portions lie in a common plane.

9. RFID antenna system comprising:

at least a first RFID antenna device comprising a magnetic antenna and a second RFID antenna device comprising at least one plane antenna, the plane antenna generates radiation in a first frequency range (f1), the magnetic antenna generates radiation in a second frequency range (f2) lower than the first frequency range (f1), and the second RFID antenna device comprising the at least one plane antenna arranged inside or in front of the frame-shaped or loop-shaped magnetic antenna, in such a way that the vertical projection of the metal, earth and/or reflector plane of the at least one plane antenna is inside the frame-shaped or loop-shaped magnetic antenna, the second RFID antenna device comprises one of the plane antennae or an array antenna comprising at least two plane antennae, and the plane antennae comprises for this purpose either a) a metal plane as a radiator device, which is divided into metal plane portions by slots, interruptions and/or recesses, the metal plane portions being galvanically isolated from or connected to one another, or b) an earth or reflector plane which acts as a balancing antenna or reflector and is provided in addition to the radiator device, projects laterally past the radiator device, and is divided into earth or reflector plane portions by slots, interruptions and/or recesses, the earth or reflector plane portions being galvanically isolated from or galvanically connected to one another, wherein the metal, earth or reflector plane comprises a plurality of metal, earth or reflector plane portions, of which at least two metal, earth and reflector plane portions are arranged in parallel with a lateral offset from one another.

10. RFID antenna system according to claim 9, further including a plurality of metal, earth or reflector plane portions are provided, and in that at least two metal, earth and reflector plane portions which overlap at least in part in a plan view so as to form a capacitive coupling.

11. RFID antenna system comprising:

at least a first RFID antenna device comprising a magnetic antenna and a second RFID antenna device comprising at least one plane antenna, the plane antenna generates radiation in a first frequency range (f1), the magnetic antenna generates radiation in a second frequency range (f2) lower than the first frequency range (f1), and the second RFID antenna device comprising the at least one plane antenna arranged inside or in front of the frame-shaped or loop-shaped magnetic antenna, in such a way that the vertical projection of the metal, earth and/or reflector plane of the at least one plane antenna is inside the frame-shaped or loop-shaped magnetic antenna, the second RFID antenna device comprises one of the plane antennae or an array antenna comprising at least two plane antennae, and the plane antennae comprises for this purpose either a) a metal plane as a radiator device, which is divided into metal plane portions by slots, interruptions and/or recesses, the metal plane portions being galvanically isolated from or connected to one another, or b) an earth or reflector plane which acts as a balancing antenna or reflector and is provided in addition to the radiator device, projects laterally past the radiator device, and is divided into earth or reflector plane portions by slots, interruptions and/or recesses, the earth or reflector plane portions being galvanically isolated from or galvanically connected to one another, further including at least two metal, earth or reflector plane portions which are arranged side-by-side so as not to overlap in a plan view.

12. RFID antenna system according to claim 1, wherein the connecting bridges adjacent to the interruptions or slots are connected electrogalvanically to the metal, earth or reflector plane portions.

13. RFID antenna system according to claim 1, wherein the slots, interruptions and/or recesses are configured in a strip shape, using two mutually parallelly extending lateral boundaries.

14. RFID antenna system according to claim 1, further including at least one interruption or recess comprising curved or converging or diverging boundary lines relative to the adjacent metal, earth or reflector plane portions.

15. RFID antenna system according to claim 1, wherein only one plane radiator is provided inside a frame-shaped or loop-shaped magnetic antenna.

16. RFID antenna system comprising:

at least a first RFID antenna device comprising a magnetic antenna and a second RFID antenna device comprising at least one plane antenna, the plane antenna generates radiation in a first frequency range (f1), the magnetic antenna generates radiation in a second frequency range (f2) lower than the first frequency range (f1), and the second RFID antenna device comprising the at least one plane antenna arranged inside or in front of the frame-shaped or loop-shaped magnetic antenna, in such a way that the vertical projection of the metal, earth and/or reflector plane of the at least one plane antenna is inside the frame-shaped or loop-shaped magnetic antenna, the second RFID antenna device comprises one of the plane antennae or an array antenna comprising at least two plane antennae, and the plane antennae comprises for this purpose either a) a metal plane as a radiator device, which is divided into metal plane portions by slots, interruptions and/or recesses, the metal plane portions being galvanically isolated from or connected to one another, or b) an earth or reflector plane which acts as a balancing antenna or reflector and is provided in addition to the radiator device, projects laterally past the radiator device, and is divided into earth or reflector plane portions by slots, interruptions and/or recesses, the earth or reflector plane portions being galvanically isolated from or galvanically connected to one another, further including at least two plane radiators which are arranged mutually offset and which are arranged together inside or substantially or approximately inside a frame-shaped or loop-shaped magnetic antenna or parallel thereto.

17. RFID antenna system according to claim 1, wherein the plane radiator comprising a metal plane comprises at least one patch antenna or one slot antenna and in that the plane radiator comprising at least one earth or reflector plane comprises at least one dipole radiator in front of the earth and/or reflector plane.

18. RFID antenna system according to claim 1, wherein one of the plane antennae radiates in the UHF range between 800 MHz and 1 GHz.

19. RFID antenna system according to claim 1, wherein the magnetic antenna operates in a frequency range below 30 MHz, including in a range around 8.2 MHz or around 13.56 MHz.

20. RFID antenna system according to claim 1, wherein the plane antenna consists of a patch antenna which comprises a substrate, a patch plane provided on the upper face of the substrate, and an earth and/or reflector plane positioned on the underside of the substrate and associated with the patch antenna.

* * * * *